US006832711B2

(12) United States Patent
Black

(10) Patent No.: US 6,832,711 B2
(45) Date of Patent: Dec. 21, 2004

(54) BACKPACK

(76) Inventor: Bradley Thomas Black, 91 Myall Street, Dubbo, New South Wales 2830 (AU)

( * ) Notice: Subject to any disclaimer, the term of this patent is extended or adjusted under 35 U.S.C. 154(b) by 0 days.

(21) Appl. No.: 10/269,108

(22) Filed: Oct. 10, 2002

(65) Prior Publication Data

US 2003/0127483 A1 Jul. 10, 2003

(30) Foreign Application Priority Data

Oct. 15, 2001 (AU) ..... PR8269
Mar. 11, 2002 (AU) ..... PS1004

(51) Int. Cl.[7] ..... A45F 3/08; A45F 3/04; A45F 3/10

(52) U.S. Cl. ..... 224/628; 224/261; 224/917

(58) Field of Search ..... 224/627, 628, 224/917, 261; 294/147, 174; 280/814

(56) References Cited

U.S. PATENT DOCUMENTS

| | | | | | |
|---|---|---|---|---|---|
| 2,224,568 | A | * | 12/1940 | Altorfer | 224/578 |
| 2,353,809 | A | * | 7/1944 | Carson | 294/165 |
| 3,504,405 | A | * | 4/1970 | Elliott-Smith | 70/58 |
| 4,269,337 | A | * | 5/1981 | Sobotka | 294/163 |
| 4,308,982 | A | * | 1/1982 | Hall | 224/607 |
| 4,326,746 | A | * | 4/1982 | Grihalva | 294/146 |
| 4,733,897 | A | * | 3/1988 | Schuetzeberg | 294/162 |
| 4,790,460 | A | * | 12/1988 | Harper, Jr. | 224/644 |
| 4,982,883 | A | * | 1/1991 | Ullal et al. | 224/651 |
| 5,016,794 | A | * | 5/1991 | Beagle, Jr. | 224/629 |
| 5,269,580 | A | * | 12/1993 | Hsiao | 294/162 |
| 5,492,254 | A | * | 2/1996 | Challoner et al. | 224/586 |
| D375,837 | S | * | 11/1996 | Frank | D3/317 |
| 5,803,332 | A | * | 9/1998 | Thompson | 224/651 |
| 5,826,771 | A | * | 10/1998 | Peng | 224/651 |
| 5,881,708 | A | * | 3/1999 | Kliot | 224/653 |
| 6,234,530 | B1 | * | 5/2001 | Carter | 280/810 |
| 6,390,347 | B1 | * | 5/2002 | Phillips | 224/611 |
| 6,502,732 | B1 | * | 1/2003 | Bonds | 224/586 |
| 6,536,639 | B1 | * | 3/2003 | Frank | 224/257 |

FOREIGN PATENT DOCUMENTS

| | | | | |
|---|---|---|---|---|
| AU | 31300/01 | | 5/2001 | |
| DE | 3323763 | A1 * | 1/1985 | A45F/3/04 |
| DE | 29712418 | U1 * | 9/1997 | A45C/11/24 |
| EP | 0612489 | A1 * | 8/1994 | 224/917 |
| WO | WO90/07960 | * | 7/1990 | |

* cited by examiner

*Primary Examiner*—Sue A. Weaver
(74) *Attorney, Agent, or Firm*—Ladas & Parry

(57) ABSTRACT

A backpack (1) for carrying a personal transportation device having forward and rear portions (3, 4). The backpack (1) includes; a harness arrangement (5) for securing to the back of a user; a body portion (10) securable to the harness (5) and having first and second ends (12, 14); and first and second securing devices (15) at each end respectively and extending outwardly therefrom to releasably engage each respective portion (3, 4) of the devices.

11 Claims, 19 Drawing Sheets

BACKPACK

TECHNICAL FIELD

The present invention relates to backpacks and in particular to backpacks for carrying personal transportation devices such as a skateboards, roller blades, shoes or the like.

BACKGROUND OF THE INVENTION

Skateboards and roller blades, for example, have become very popular around the world. Generally, a skateboard or roller blade user travels along a given path until prevented from doing so, at which time they pick the skateboard up or remove their roller blades and carry them by hand or place then loosely in a bag. For many people, the awkwardness of carrying a skateboard or roller blades causes discomfort due to the inconvenience of having one or both hands occupied, restricting movement and possibly knocking the skateboard/roller blades or the user and damaging one or more skateboard/roller blade components.

A number of proposals to carry a skateboard, for example, have been devised. Once such example is a carry bag which retains the skateboard completely therein. A further example includes two fabric flaps attached to the sides of a standard backpack. The deck of the skateboard is placed between the flaps which overlap and secure the skateboard through use of Velcro connections. In the case of roller blades, they are usually loosely placed in a standard backpack.

The prior art proposals have several disadvantages, including: being too flexible, due to the packs being manufactured entirely out of fabric; bulkiness; insufficient amounts of tension in the flaps to fasten the skateboard (as the skateboard is fastened only between two unrigid components); movement of the skateboard between the flaps and the bag causing wear; the unsecured roller blades hitting each other whilst free to move in a backpack and an undesirable amount of time needed to load and unload skateboards and roller blades.

OBJECT OF THE INVENTION

It is an object of the present invention to substantially overcome or at least ameliorate one or more of the disadvantages of the prior art, or at least to provide a useful alternative.

SUMMARY OF THE INVENTION

There is firstly disclosed herein a backpack for carrying a personal transportation device having forward and rear portions, said backpack including:

a harness arrangement for securing to the back of a user;

a body portion securable to said harness and having first and second ends; and first and second securing means at each said end respectively and extending outwardly therefrom to releasably engage each respective portion of said device.

Preferably, said device, when engaged, is retained substantially parallel to and adjacent said body portion.

Preferably, one of said first and second securing means includes a pair of hooks.

Preferably, one of said first and second securing means, in use, is resiliently biasable into engagement with one of said portions.

Preferably, said resiliently biased securing means includes a spring loaded hinged arm to effect said biasing.

Preferably, said arm includes a pair of hooks.

Preferably, one of said first and second securing means is a support plate.

Preferably, one of said first and second securing means is an adjustable support bar.

Preferably, one of said first and second securing means includes a strap assembly to further retain said device to said body portion.

Preferably, said body portion is contoured to the shape of said back of said user.

Preferably, said body portion is rigid.

Preferably, said body portion is manufactured of a hard plastics material.

Preferably, said device is a skateboard, pair of roller blades or pair of shoes.

BRIEF DESCRIPTION OF THE DRAWINGS

A preferred form of the present invention will now be described, by way of example only, with reference to the accompanying drawings wherein.

DETAILED DESCRIPTION OF THE PREFERRED EMBODIMENTS

Figure 12:
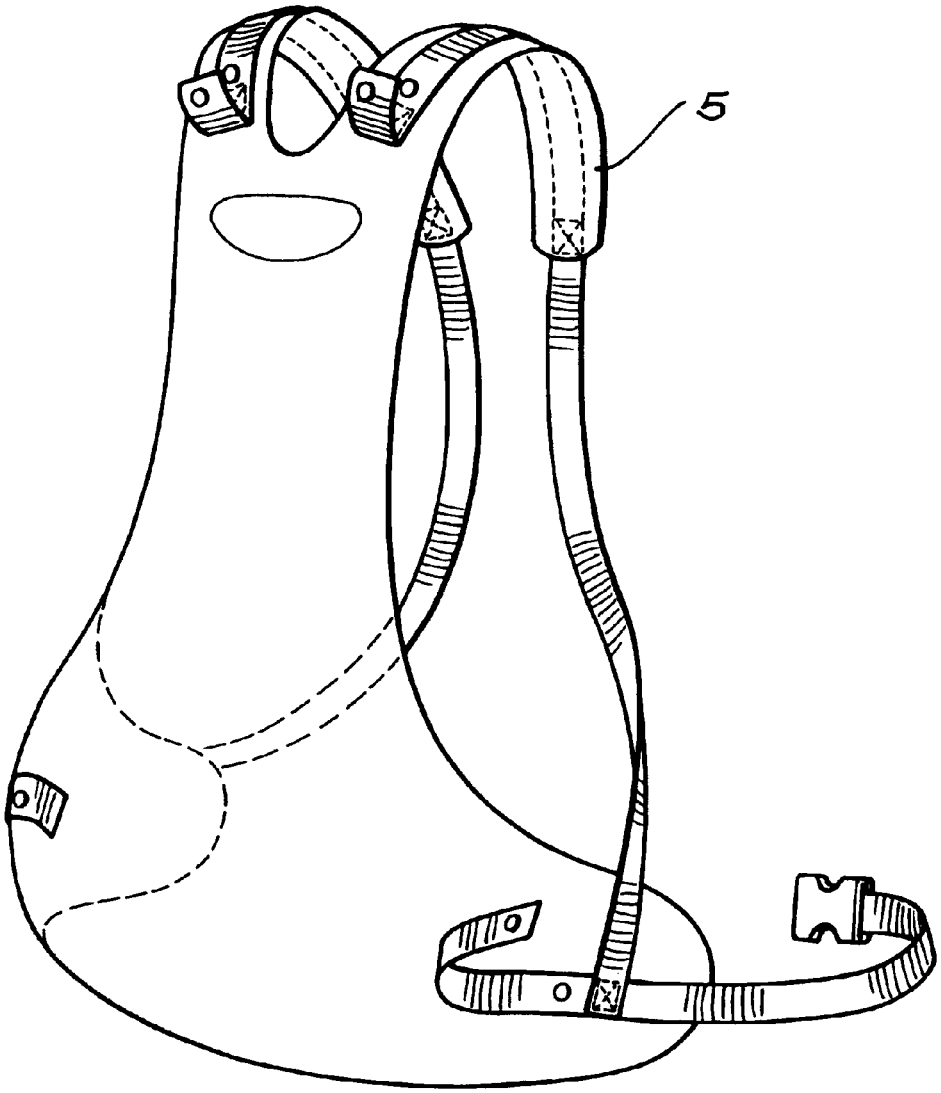
FIG. 12 shows a harness arrangement which the rigid body of a backpack could be attached.

In the accompanying drawings, there is schematically depicted a backpack 1 for carrying a transportation device, such as a skateboard 2 having a deck supporting forward and rear trucks or a pair of roller blades or shoes having forward and rear portions 3, 4. The backpack 1 includes a harness 5 for securing to the back of a user. The harness 5 can be of any typical backpack harness arrangement. However, an example is shown at FIG. 12. A body portion 10 is securable to the harness 5 and has first and second ends 12, 14. First and second securing means 15 are located respectively at each of the first and second ends 12, 14 of the body portion 10 and extend outwardly therefrom to releasably engage a respective truck of a skateboard 2 or the forward and rear ends of roller blades or shoes 3, 4 such that the skateboard/roller blades/shoes when engaged are retained substantially parallel to and adjacent the body portion 10. With regard to a skateboard 2 as each securing means 15 extends outwardly away from each other the skateboard 2 attached therebetween is placed in tension.

Figure 4:
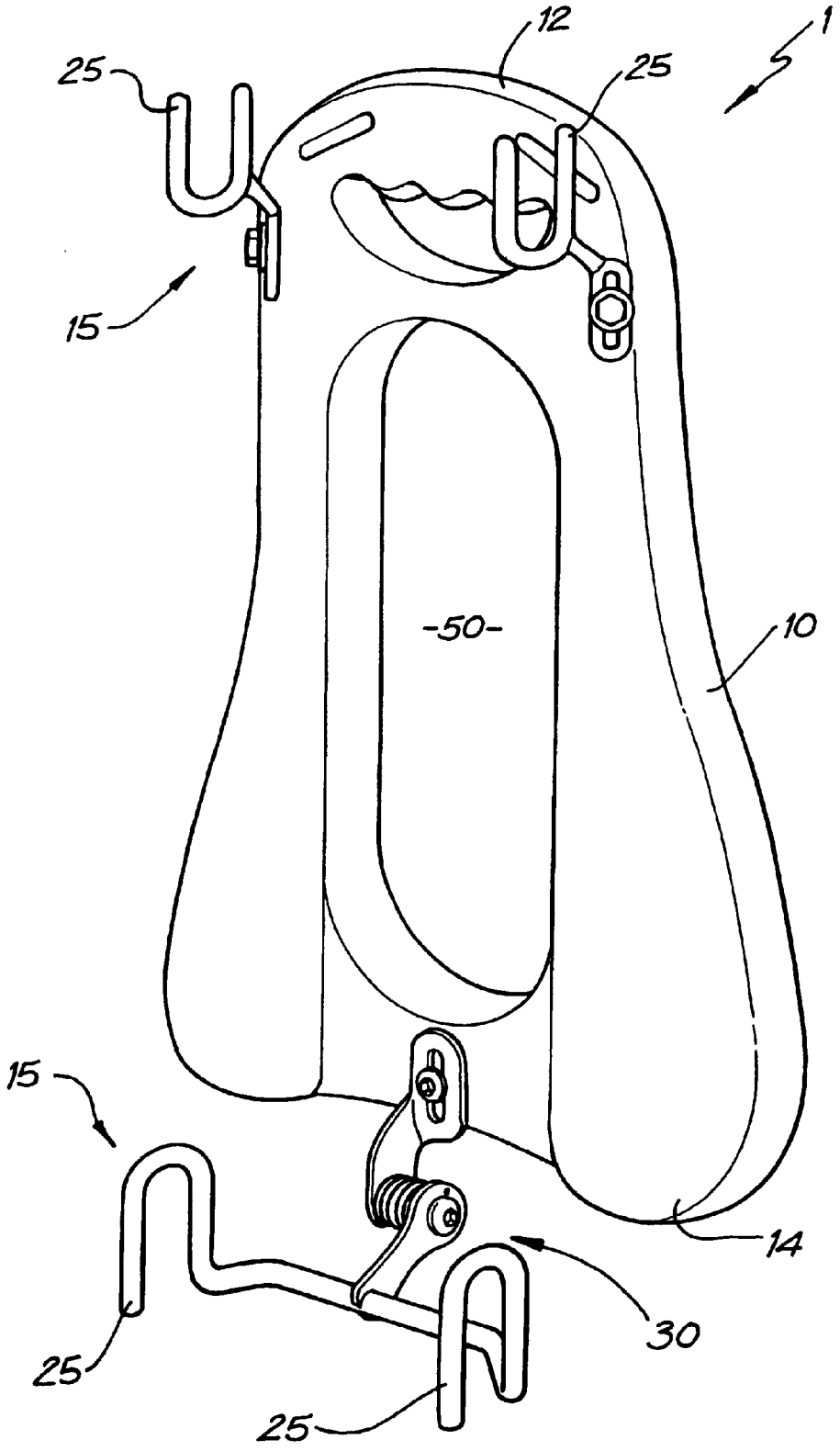
FIG. 4 is a perspective view of another backpack for transporting a skateboard.
Figure 5:
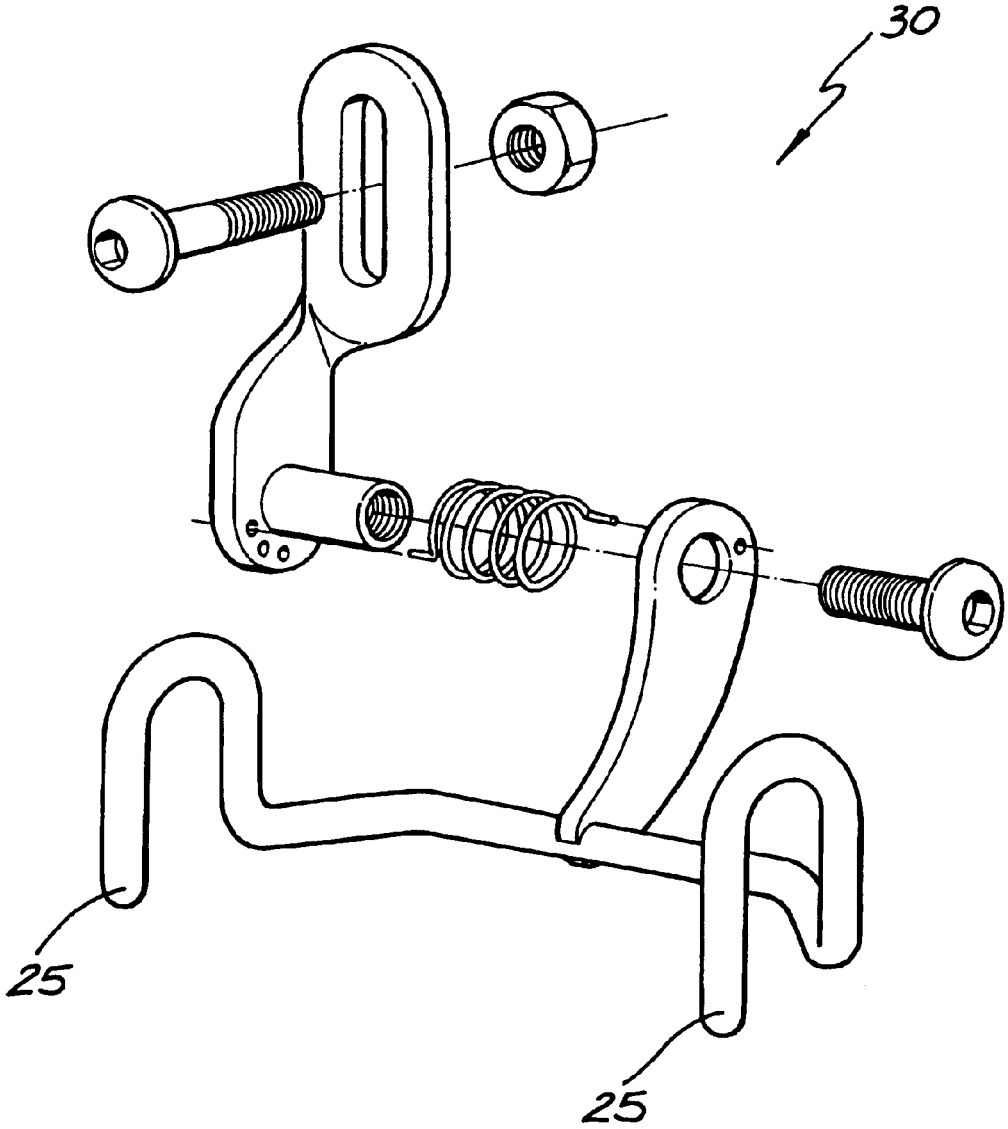
FIG. 5 is a parts exploded view of the spring loaded securing means of FIG. 4.
Figure 6:
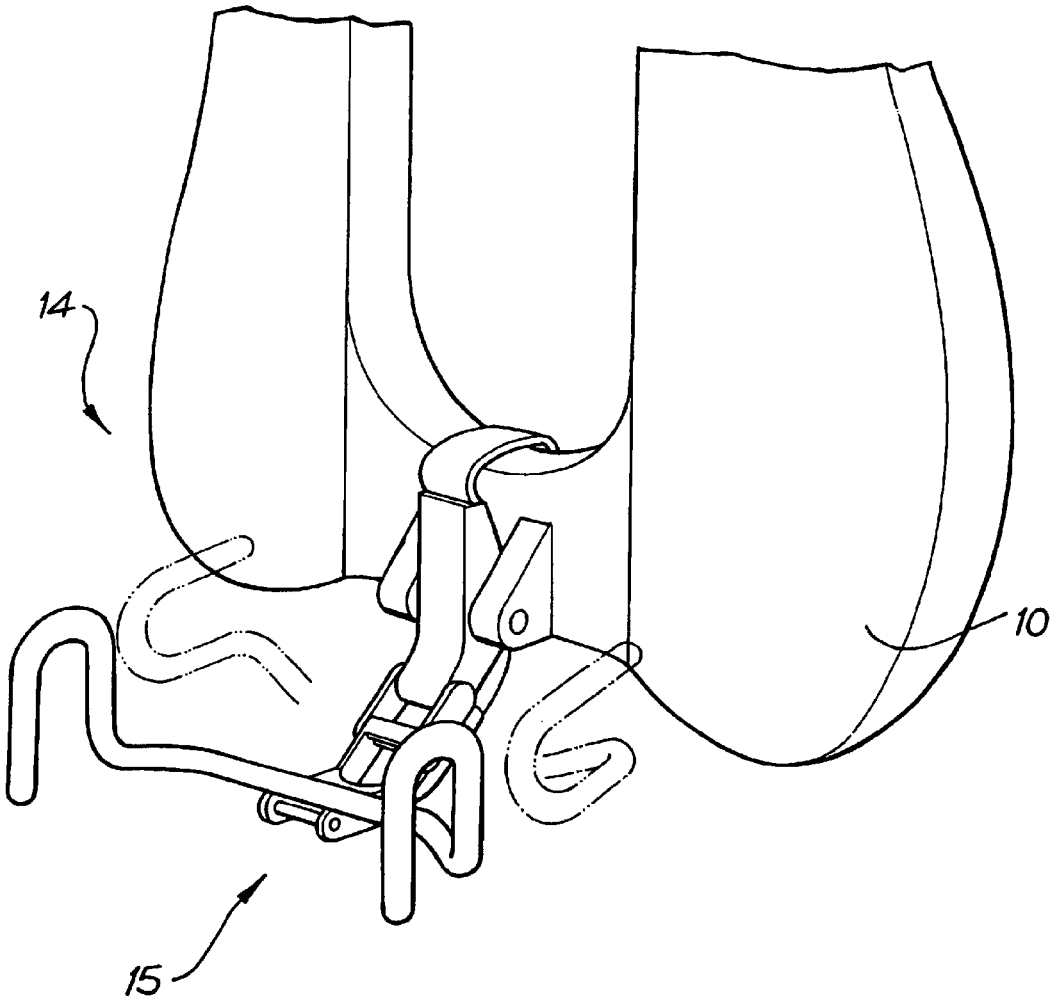
FIG. 6 is a partial perspective view of another backpack for transporting a skateboard.

The backpack 1 of the invention provides for several different arrangements of securing means 15. For example, in FIGS. 1*a* to 4 one of the first and second securing means 15 includes a pair of hooks 25. Alternatively, and as shown in FIGS. 4, 5, 6 and 8*a* to 8*c* one of the first and second securing means 15 is in the form of one or more adjustable spring loaded hinged arms 30 which in use are resiliently biasable into engagement with one of the trucks to retain the skateboard adjacent the body portion 10. The arm 30 can also include as shown in FIGS. 4, 5 and 6 a further pair of hooks 25. With particular reference to FIG. 6, the arm 30 is collapsible to prevent injury or breakage.

Figure 1A:
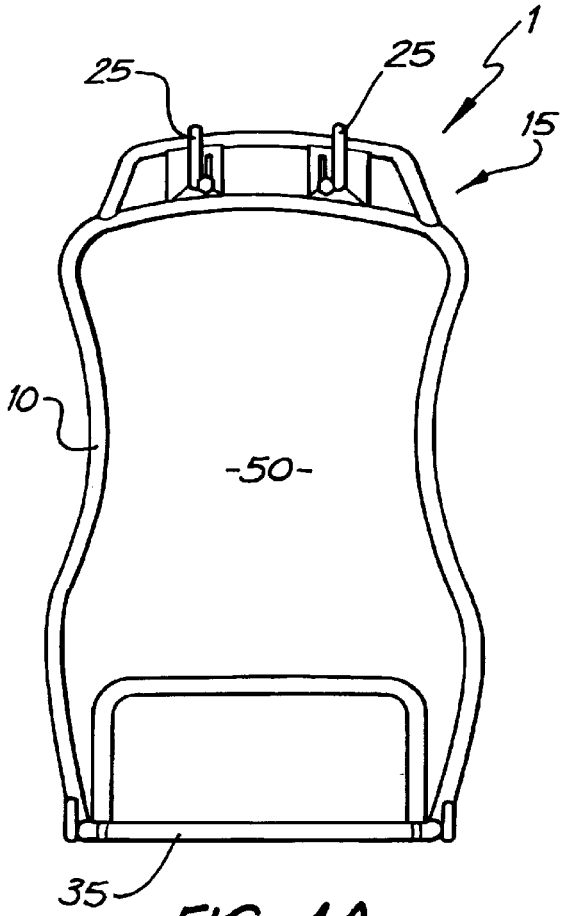
FIGS. 1*a*, 1*b* and 1*c* are front, side and plan views of a backpack for transporting a skateboard.
Figure 1B:
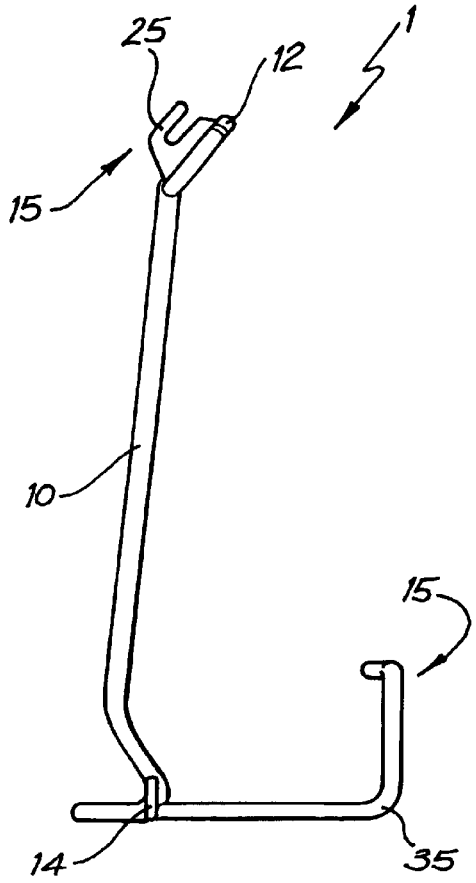
Figure 1C:
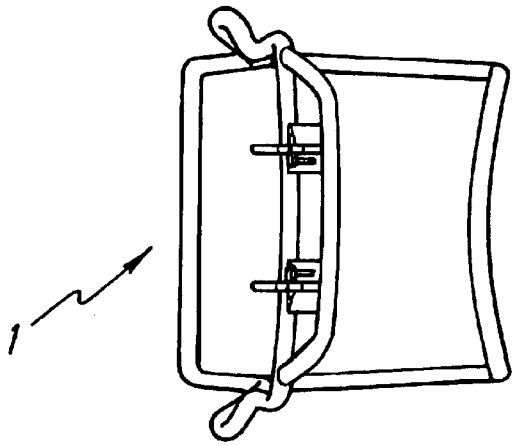
Figure 2:
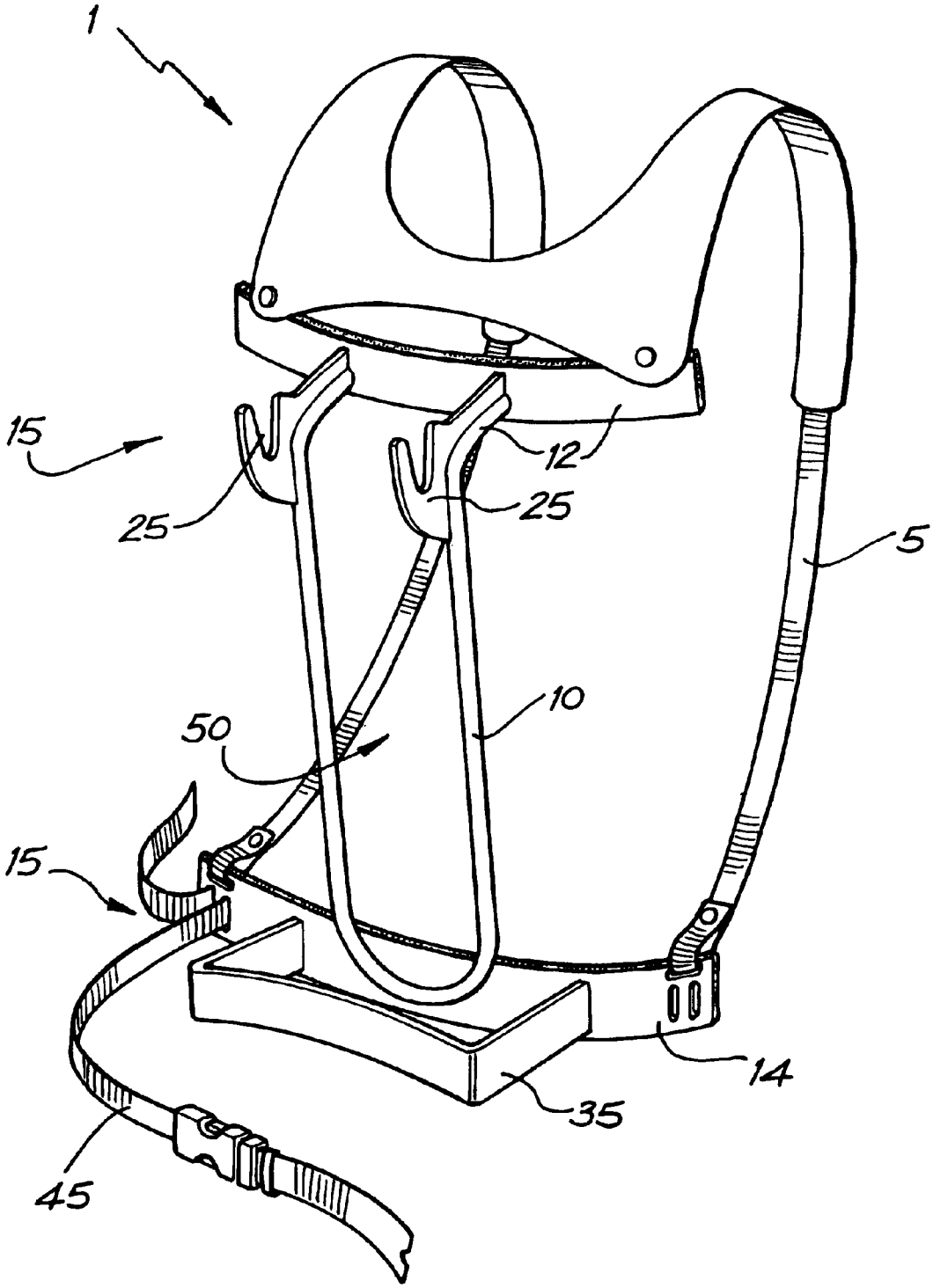
FIG. 2 is a perspective view of another backpack for transporting a skateboard.
Figure 3:
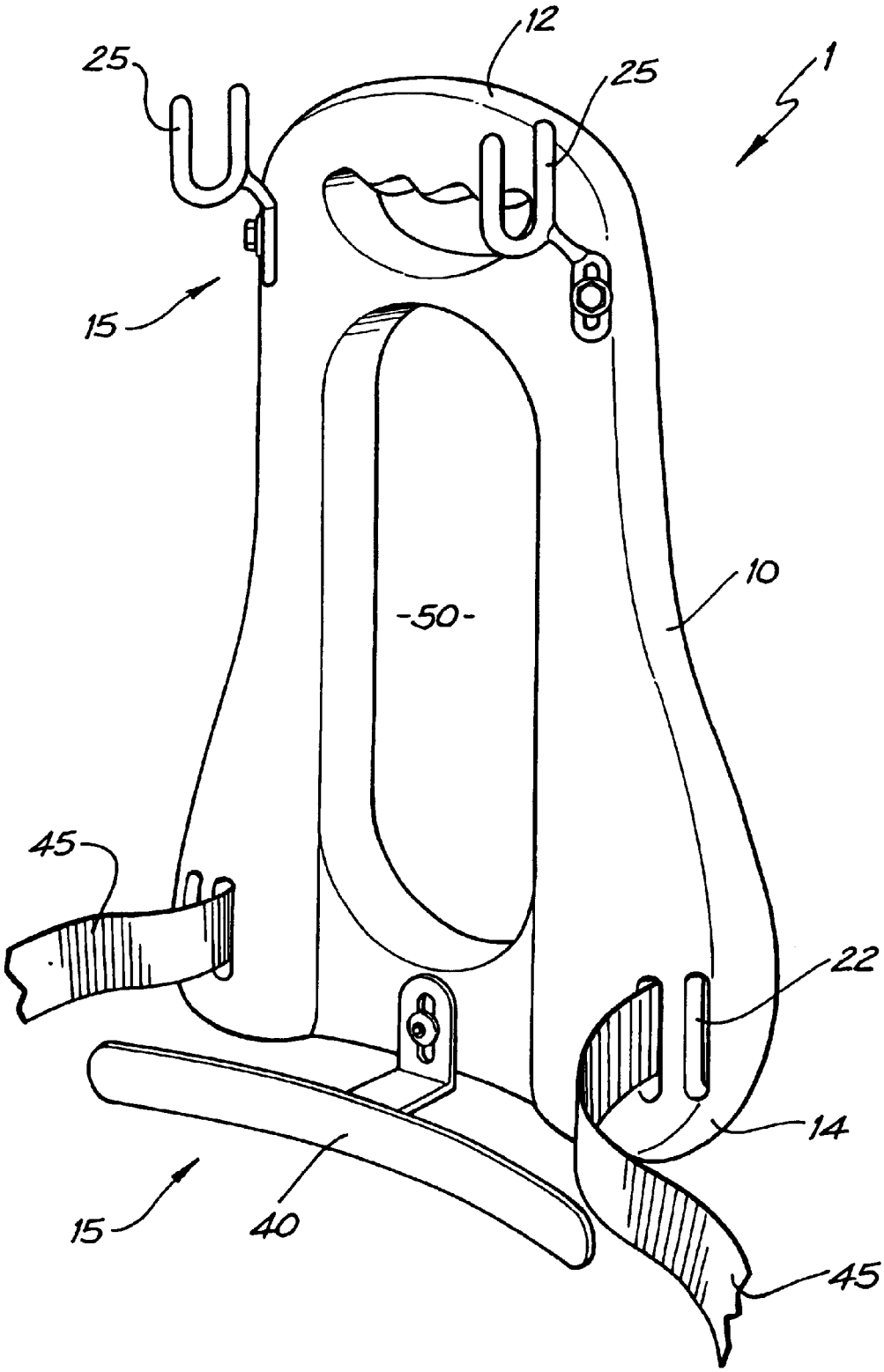
FIG. 3 is a perspective view of another backpack for transporting a skateboard.
Figure 10:
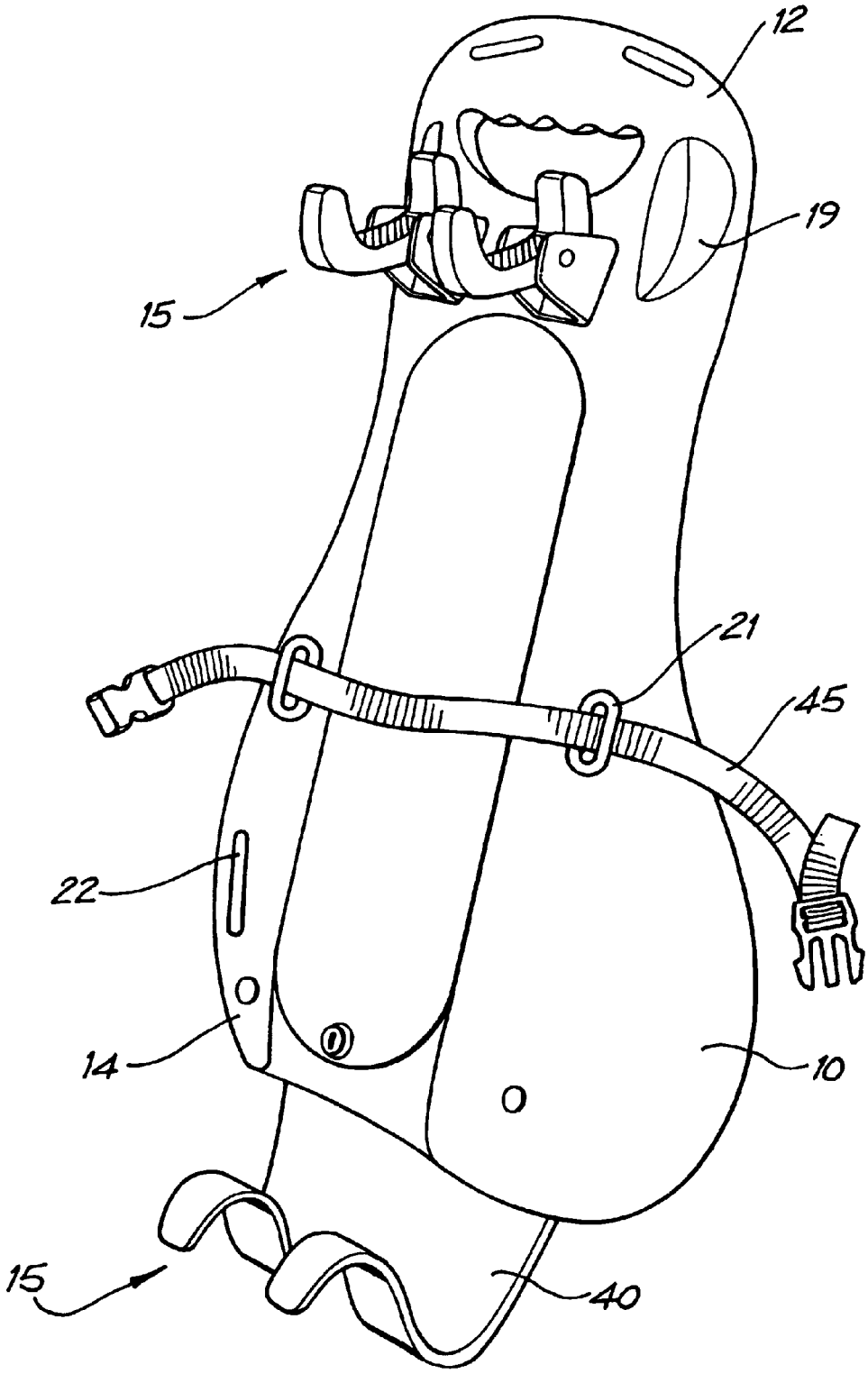
FIG. 10 shows a perspective view of another backpack for transporting a skateboard.

In further arrangements, one of the first and second securing means 15 as shown in FIGS. 1*a*, 1*b*, 1*c* and 2 is a support plate 35 and in FIGS. 3 and 8*a* to 8*c*, 10, 11 and 14*a* to 14*c* is an adjustable support bar or plate 40. These types of securing means can also include a strap assembly 45 as shown in FIGS. 3 and 10 to further retain the skateboard or any other item to the body portion 10. Any typical strap assembly could be utilised. As seen in FIG. 10, the strap 45 may be held to the body portion 10 by rings 21 or cut outs 22 as in FIG. 3, for example.

Figure 8A:
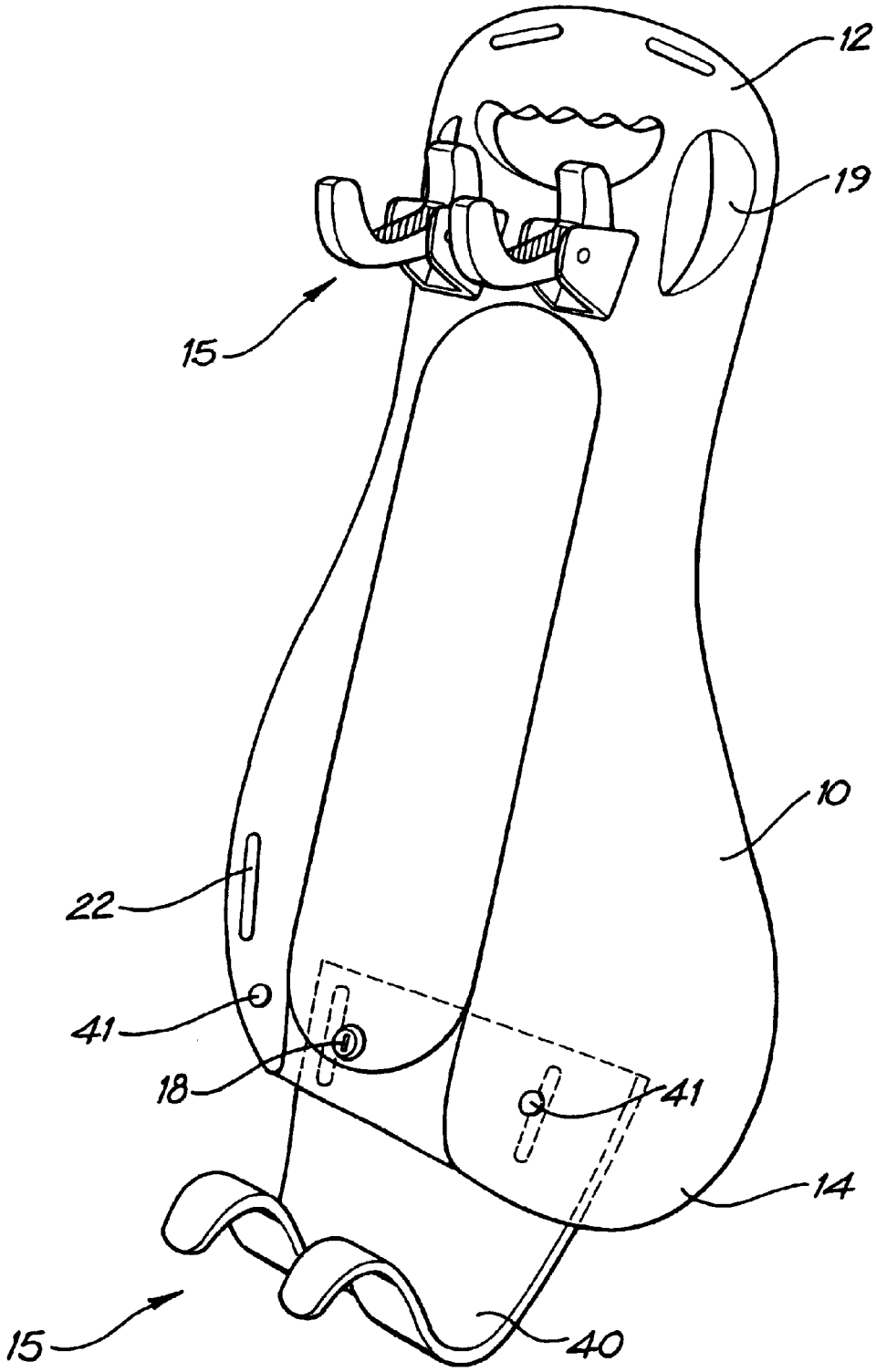
FIGS. 8*a*, 8*b* and 8*c* are perspective, front and side views of another backpack for transporting a skateboard.
Figure 8B:
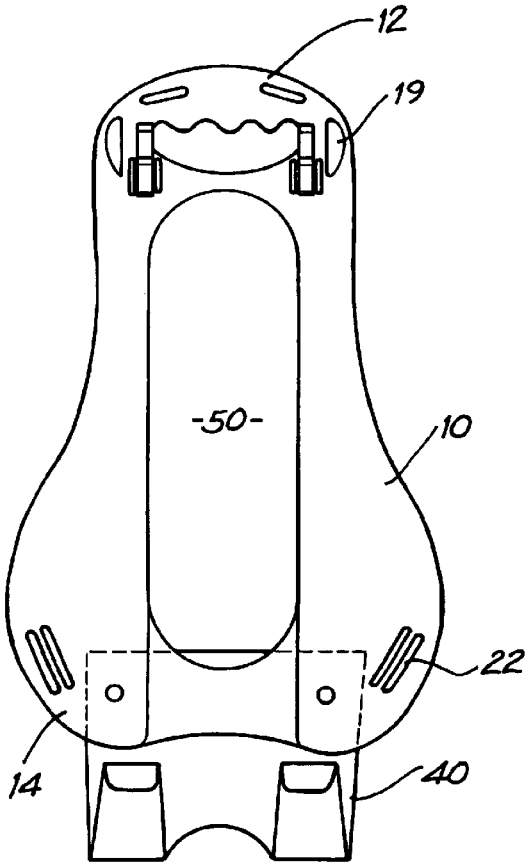
Figure 8C:
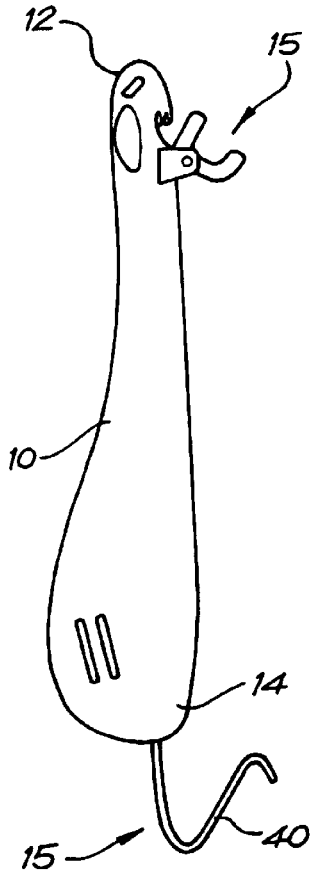

Specifically, FIGS. 8*a* to 8*c* shows a perspective view of a backpack for carrying a skateboard 2 having a bottom securing plate 40 adjustable by fasteners 41 and spring loaded securing hooks 15 that rest biasly, opened or closed. A storage compartment 17 is centrally located and has a lockable lid 18 and is hinged to the body portion 10 (it may be locked or hinged in various positions). Cut outs 19 allow the skateboard wheels to rest more easily, helping eliminate bulkiness.

Figure 7A:
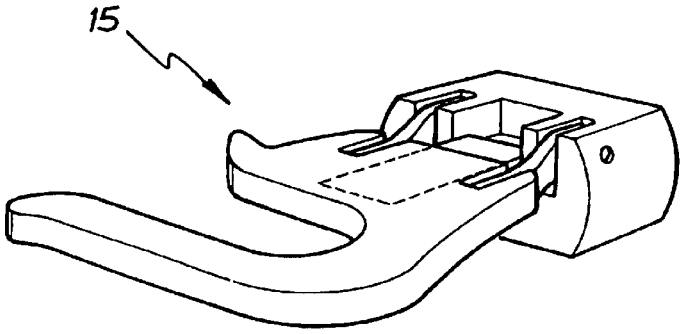
FIGS. 7*a*, 7*b* and 7*c* are partial perspective views of alternate securing means.
Figure 7B:
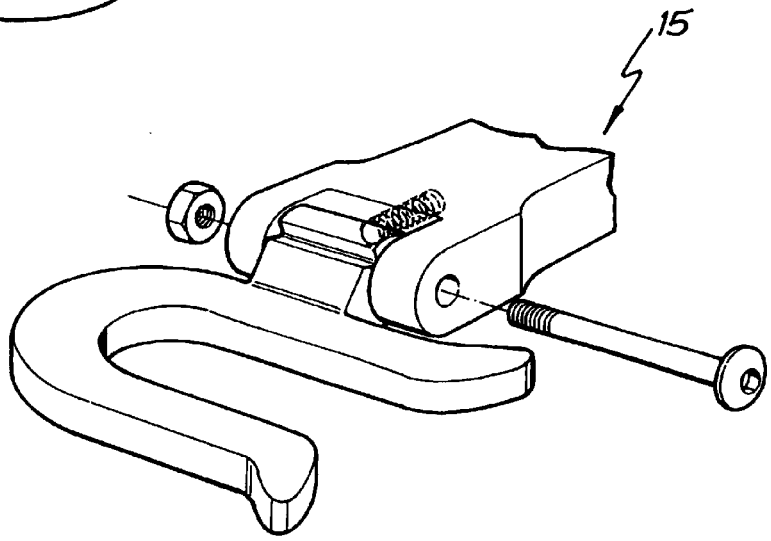
Figure 7C:
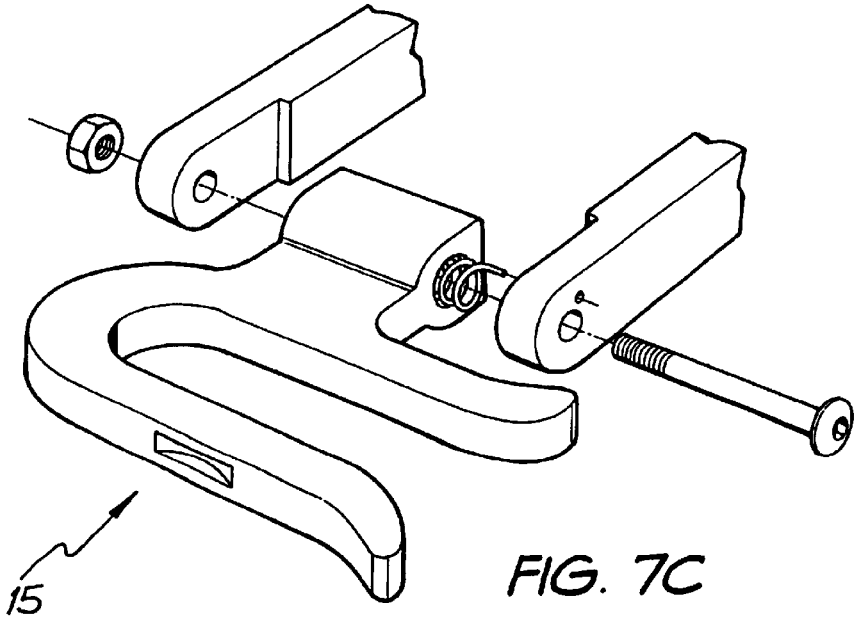

The securing means 15 can also be rigidly fixed away from the body portion 10 or may be folded back into the body portion 10 to prevent injury or breakage as shown in FIGS. 7*a*–7*c*. Various other securing means could be used.

Figure 14A:
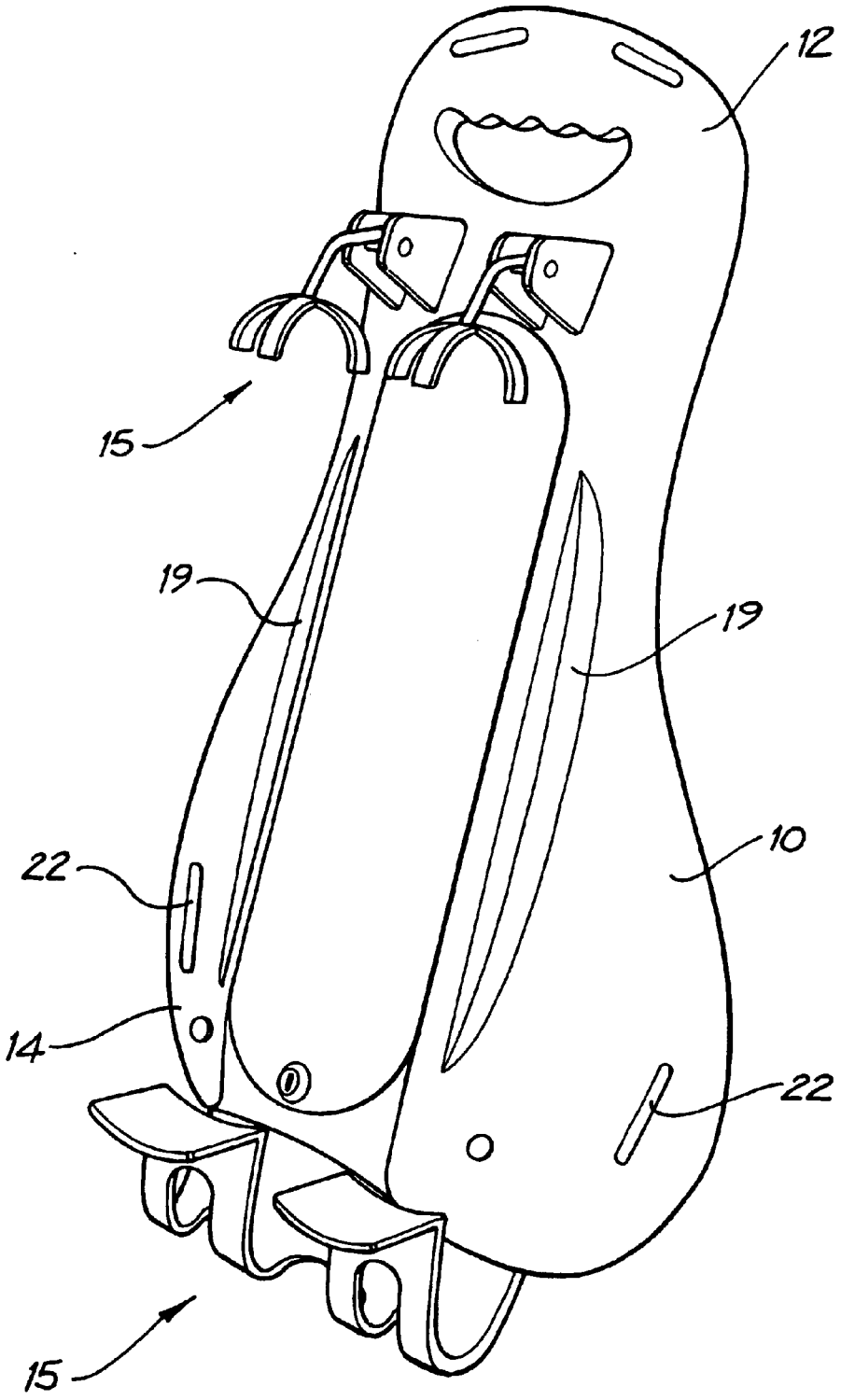
FIGS. 14*a*, 14*b* and 14*c* show perspective, front and side views of a backpack for transporting roller blades/shoes.
Figure 14B:
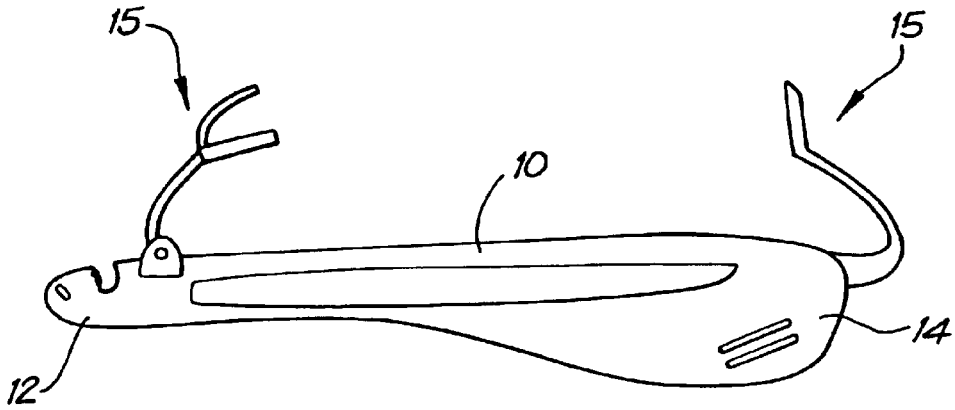
Figure 14C:
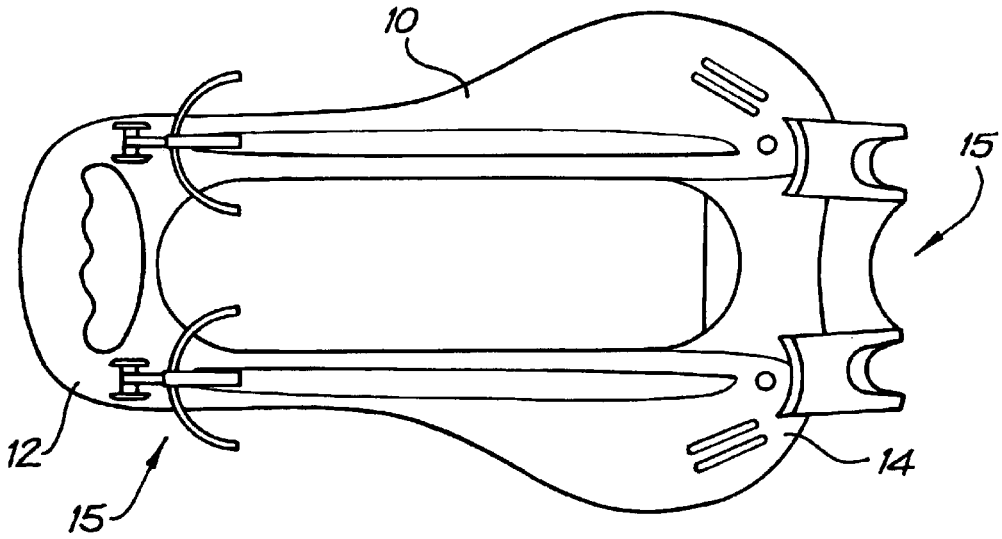

As shown in FIGS. 14*a* to 17 these and alternate arrangements can be utilised for carrying roller blades as shown. Specifically, FIG. 14*a* shows a perspective view of a backpack for carrying roller blades/shoes and having an alternate bottom securing plate 40 adjustable by fasteners 41 and spring loaded securing devices 15 that create a downward force. Further, cut outs 19 allow the roller blade wheels to rest more easily and help eliminate bulkiness.

Figure 11:
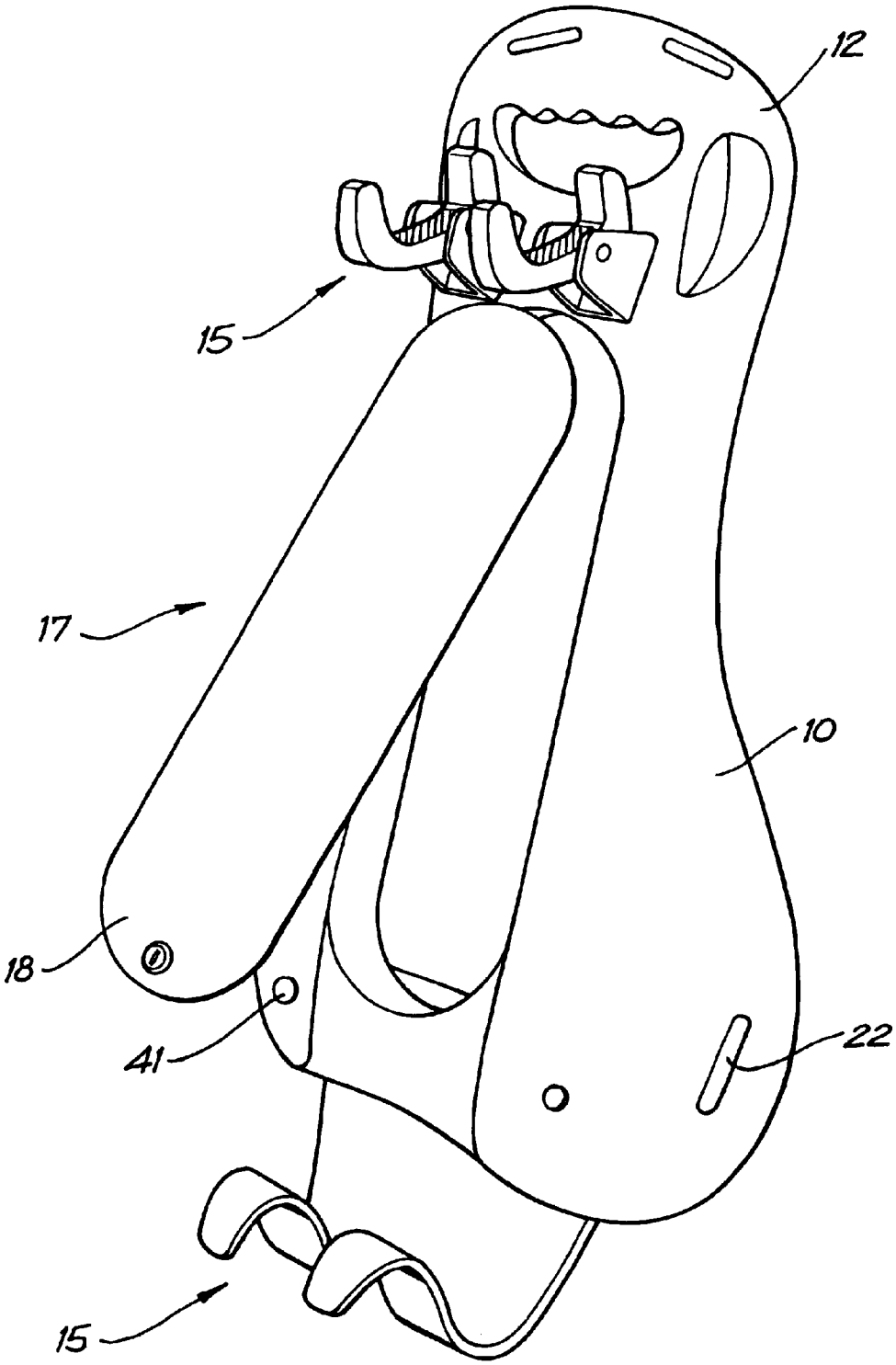
FIG. 11 shows the backpack of FIG. 10 having a compartment with lid, unlocked and opened.
Figure 13:
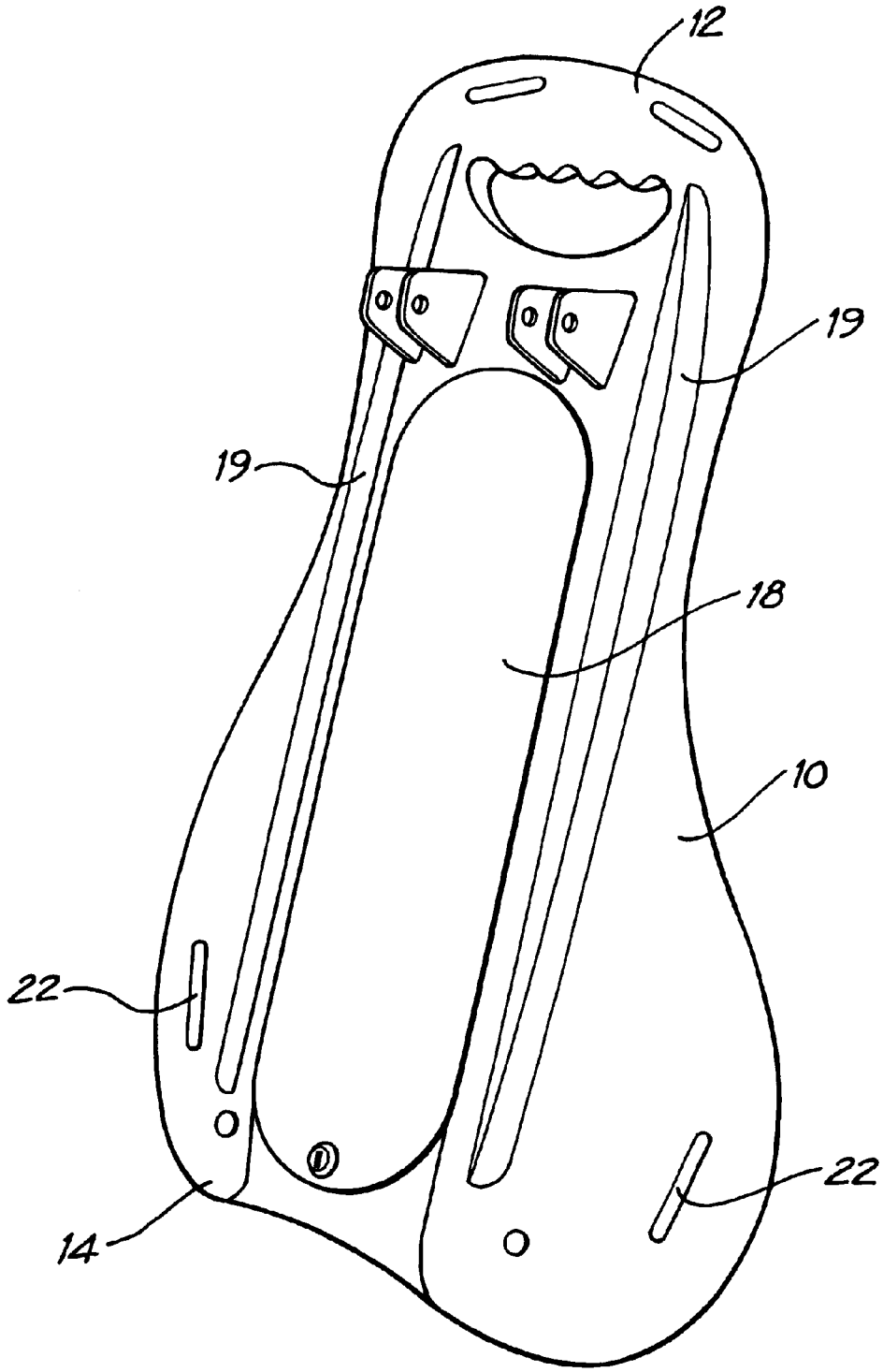
FIG. 13 shows a perspective view of an alternate body portion of a backpack.

As shown in FIGS. 3, 4 and 13 the body portion 10 is contoured to the shape of the back of a user and is substantially stiff and/or rigid and is preferably manufactured of a hard plastics material. However, any shape and/or material could be used. In this embodiment, a hollow 50 is provided which can accommodate a bag structure (not shown) for carrying articles. In FIG. 11, a fixed compartment 17 having a lockable lid 18 is shown. Additional storage could be added through use of zippers, Velcro, studs or other means.

In use, the backpack 1 of a preferred embodiment provides a personal transportation carrying device having a rigid back plate with two hooks at the top suspending a skateboard, for example, by its trucks for fastening of the skateboard to the pack in a variety of adjustable ways. By having the skateboard tensioned to the body portion and spaced at a distance from the back of a user makes it unobtrusive to a user's body. Similar arrangements for roller blades and shoes are also disclosed.

In the arrangement shown in FIGS. 4, 5, 6 tension is obtained by the spring loaded arm creating a downward force on the bottom rear trucks adding to the already downward force created by the weight of the skateboard hanging from the hooks. In FIGS. 8*a* to 8*c* tension is obtained by the spring loaded arms 15 but there is no downward force, the board pivots on its bottom rear trucks at the hooks formed in plate 40 towards the top hooks locking the trucks to the body portion 10. In the arrangement of FIGS. 4 to 6, the spring loading there is no manual adjusting as the spring takes up the slack automatically. In FIGS. 8*a* to 8*c*, manual adjustment can be made by loosening fasteners 41 and adjusting to suit a particular board length.

Figure 9A:
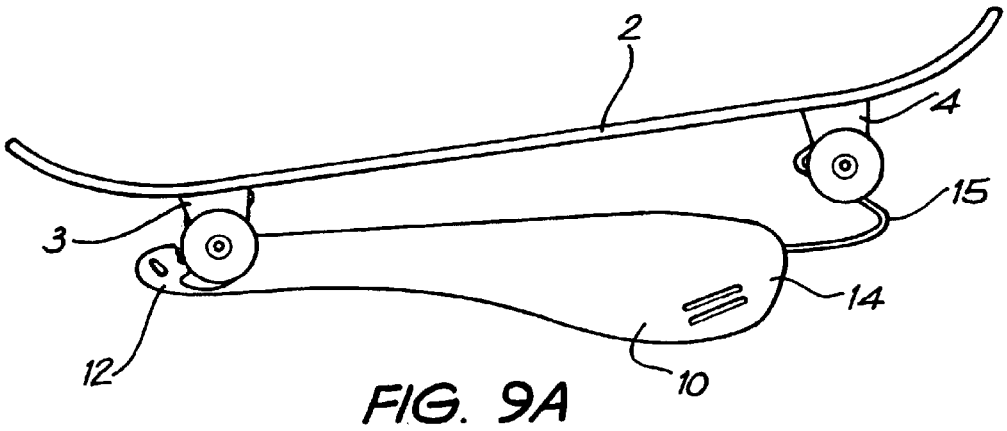
FIGS. 9*a*, 9*b* and 9*c* show the loading/unloading sequence of a skateboard from the backpack of FIG. 8.
Figure 9B:
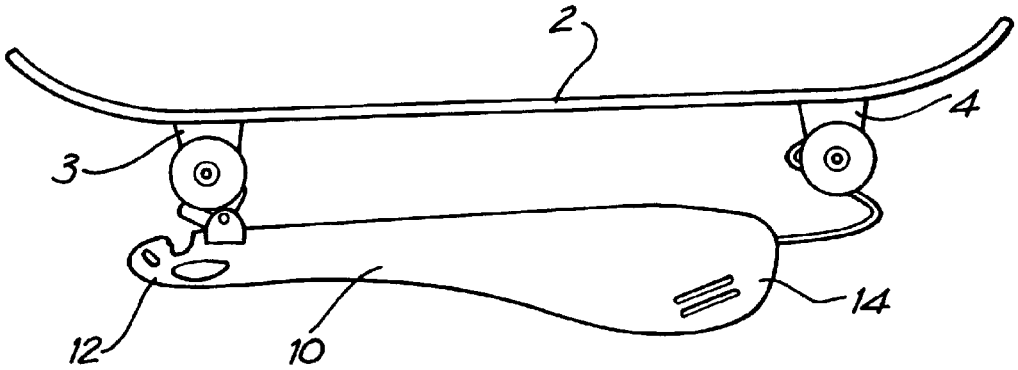
Figure 9C:
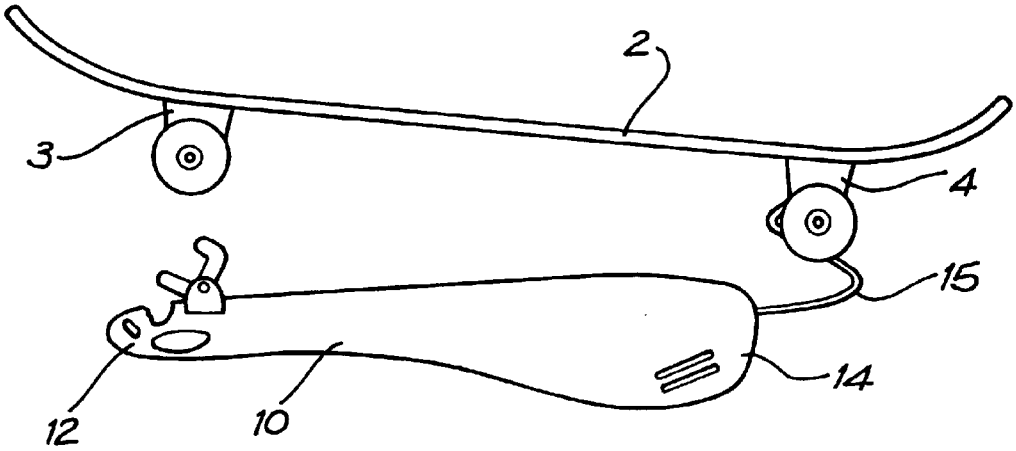
Figure 15A:
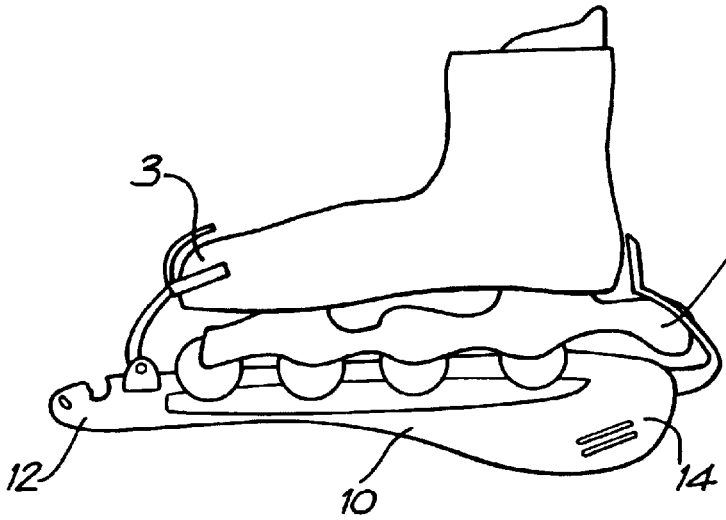
FIGS. 15*a*, 15*b* and 15*c* show the loading/unloading sequence of a roller blade from the backpack of FIG. 14*a;*
Figure 15B:
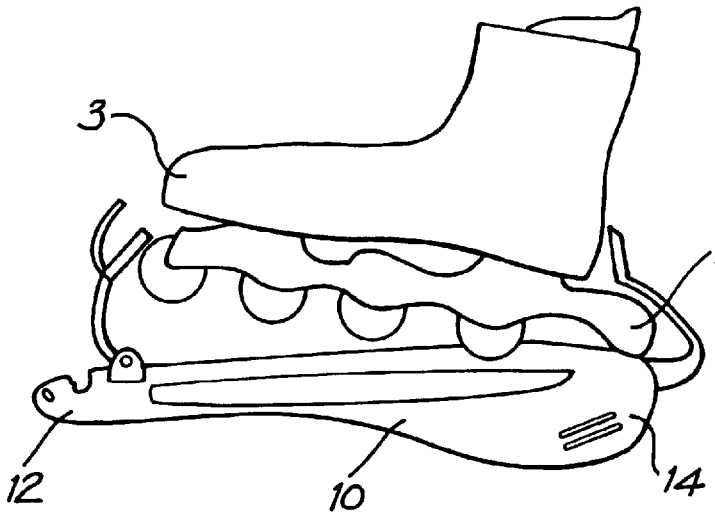
Figure 15C:
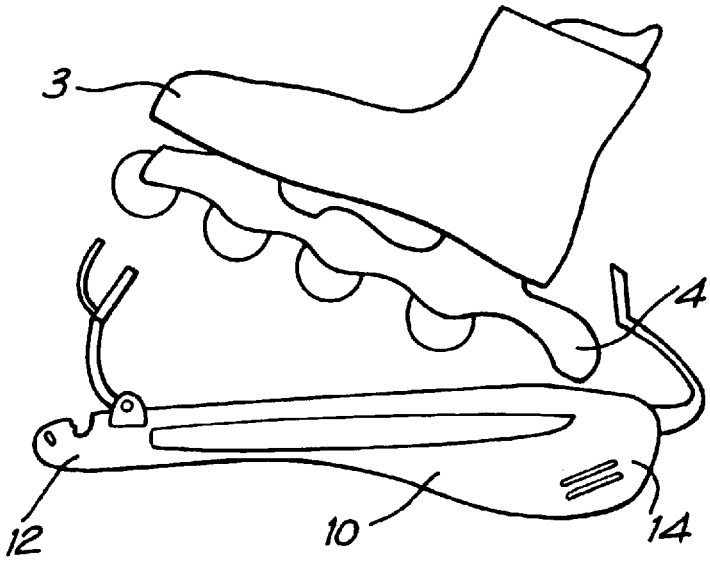
Figure 16A:
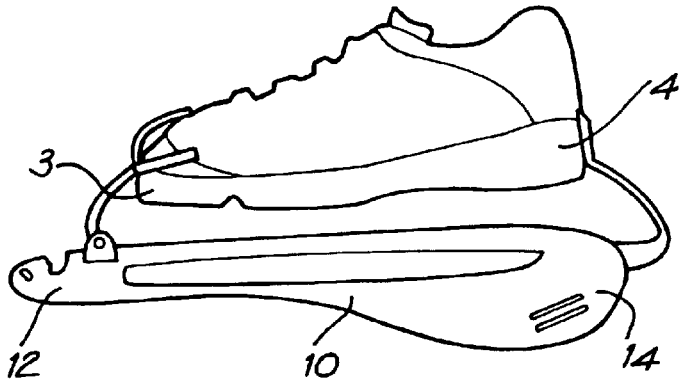
FIGS. 16*a*, 16*a* and 16*c* show the loading/unloading sequence of a shoe from the backpack of FIG. 14*a*.
Figure 16B:
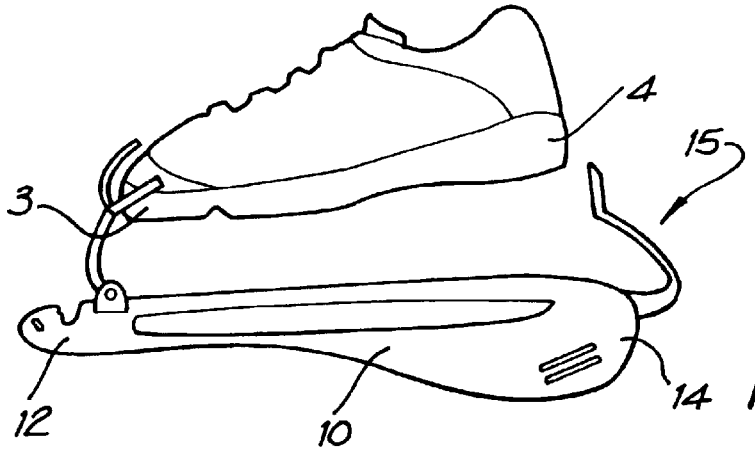
Figure 16C:
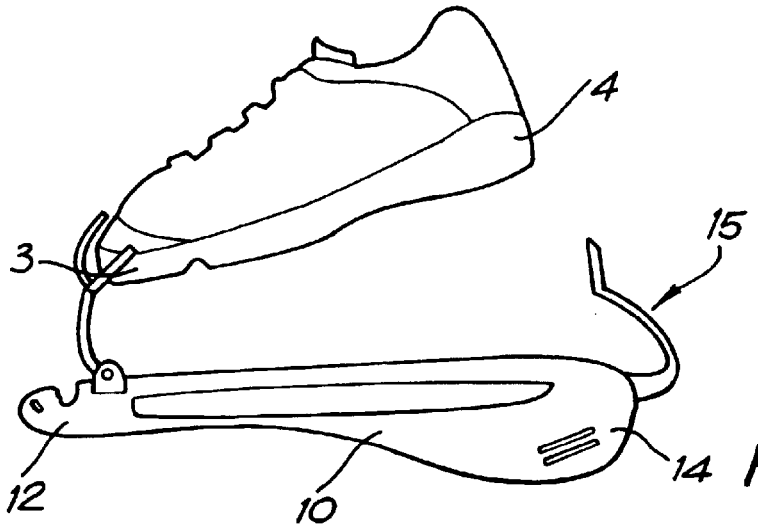
Figure 17:
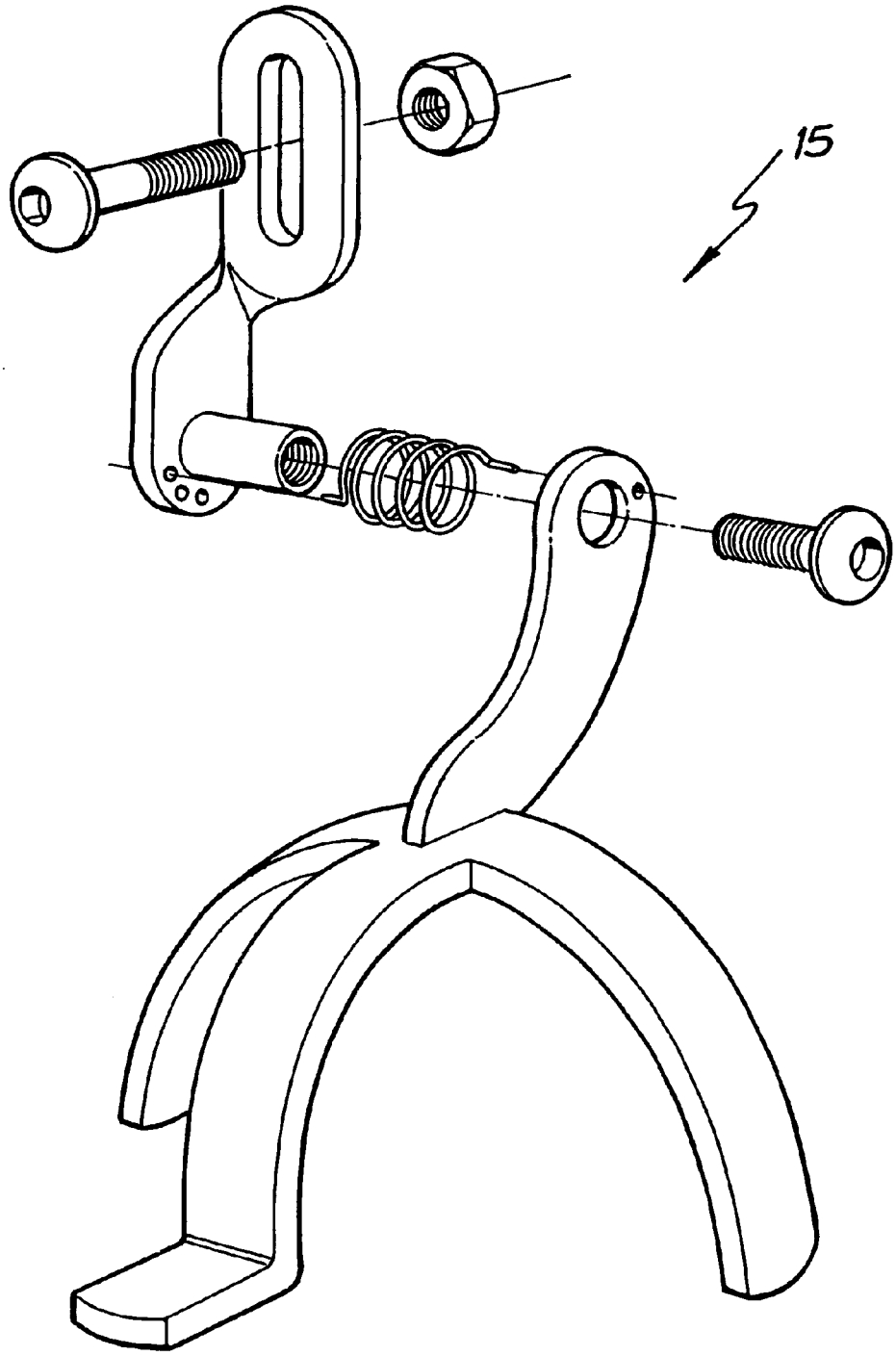
FIG. 17 is a parts exploded of a tensioning device for roller blades/shoes.

The loading/unloading sequences are shown in FIGS. 9*a* to 9*c*; 15*a* to 15*c* and 16*a* to 16*c*. FIGS. 9*a* to 9*c* show the loading of a skateboard, as it pivots from its bottom trucks on the support plate 40, towards the spring loaded hooks 15. It moves over the first arm striking the second, locking the board 2 in place. To remove the board 2 you simply pull the top of the board away from the body portion 10. FIGS. 15*a* to 15*c* similarly show the loading of a roller blade as the top arm is sprung back the blade is placed between the spring loaded arm and the fixed bottom plate, being compressed between the two there is efficient amounts of tension. To remove the blade you simply lift it up and pull it out. FIGS. 16*a* to 16*c* similarly shows the loading of a shoe, which is placed at the top hook lifted upwards and placed on the bottom securing plate compressed therebetween. Unloading of the shoe can be completed by lifting upwards and pulling outwards.

Although the invention has been described with reference to specific examples, it will be appreciated by those skilled in the art that the invention may be embodied in many other forms.

What is claimed is:

1. A backpack for carrying a personal transportation device having forward and rear portions, said backpack including:

a harness arrangement for securing to the back of a user;

a body portion securable to said harness and having first and second ends;

first and second securing means at each end respectively and extending outwardly therefrom to releasably engage each respective portion of said device; and wherein one of said fist and second securing means, in use, is resiliently biasable into engagement with one of said portions, said resiliently biassed securing means including a spring loaded hinged arm to effect said biasing.

2. The backpack of claim 1, wherein said device, when engaged, is retained substantially parallel to and adjacent said body portion.

3. The backpack of claim 1, wherein said one of said first and second securing means includes a pair of hooks.

4. The backpack of claim 1, wherein said arm includes a pair of hooks.

5. The backpack of claim 1, wherein one of said first and second securing means is a support plate.

6. The backpack of claim 1, wherein one of said first and second securing means is an adjustable support bar.

7. The backpack of claim 1, wherein one of said first and second securing means includes a strap assembly to further retain said device to said body portion.

8. The backpack of claim 1, wherein said body portion is contoured to the shape of said back of said user.

9. The backpack of claim 1, wherein said body portion is rigid.

10. The backpack of claim 1, wherein said body portion is manufactured of a hard plastics material.

11. The backpack of claim 1, wherein said device is a skateboard, pair of roller blades or pair of shoes.

* * * * *